US005383415A

United States Patent [19]

Padgett, III

[11] Patent Number: 5,383,415

[45] Date of Patent: Jan. 24, 1995

[54] TEXTURED SURFACE EFFECT FABRIC AND METHODS OF MANUFACTURE

[75] Inventor: William P. Padgett, III, Rome, Ga.

[73] Assignee: Burlington Industries, Inc., Greensboro, N.C.

[21] Appl. No.: 995,297

[22] Filed: Dec. 21, 1992

[51] Int. Cl.[6] ..... D05C 15/04

[52] U.S. Cl. ..... 112/266.2; 112/80.73

[58] Field of Search ..... 112/266.2, 80.7, 80.72, 112/80.73, 80.23

[56] References Cited

U.S. PATENT DOCUMENTS

| | | | |
|---|---|---|---|
| 2,811,244 | 10/1957 | MacCaffray, Jr. . | |
| 2,842,259 | 7/1958 | Hoeselbarth . | |
| 2,866,424 | 12/1958 | Masland, II . | |
| 2,882,845 | 4/1959 | Hoeselbarth . | |
| 2,883,735 | 4/1959 | Hoeselbarth . | |
| 2,932,181 | 4/1960 | MacCaffray, Jr. . | |
| 2,965,054 | 12/1960 | Masland, II . | |
| 2,991,738 | 7/1961 | Zenner et al. . | |
| 3,095,840 | 7/1963 | Ballard . | |
| 3,095,841 | 7/1063 | Ballard et al. . | |
| 3,103,903 | 9/1963 | Broadrick et al. . | |
| 3,109,395 | 11/1963 | Batty et al. . | |
| 3,110,905 | 11/1963 | Rhodes . | |
| 3,112,721 | 12/1963 | Obertholtzer et al. . | |
| 3,943,865 | 3/1976 | Short et al. . | |
| 4,221,317 | 9/1980 | Fukuda et al. . | |
| 4,867,080 | 9/1989 | Taylor et al. | 112/80.73 X |
| 4,903,625 | 2/1990 | Card et al. | 112/80.41 X |
| 4,981,091 | 1/1991 | Taylor et al. . | |
| 5,005,498 | 4/1991 | Taylor et al. | 112/80.73 X |

FOREIGN PATENT DOCUMENTS

| | | |
|---|---|---|
| 2144778 | 3/1985 | United Kingdom . |
| 2216553 | 10/1989 | United Kingdom . |

OTHER PUBLICATIONS

"Moving Toward Total Automation," Frank O'Neill, pp. 22–28, Carpet & Rug Industry, Dec. 1990.

"Innovations in Tufting Machinery Design," Frank W. Schedwill, Melliand English, Jan. 1991.

"Automated Yarn Control" Carpet & Rug Industry article, Feb. 1991.

"Tufting Technology Still Ahead of its Time" Frank O'Neill, pp. 21, 22, 27, 28, 45, Dec., 1991.

*Primary Examiner*—Clifford D. Crowder
*Assistant Examiner*—Paul C. Lewis
*Attorney, Agent, or Firm*—Nixon & Vanderhye

[57] ABSTRACT

Tufting apparatus includes servomotors driving front and back yarn feed rolls for feeding yarns to the needles of the front and back needle bars, respectively. Incremental servomotor control for each stitch enables a height differential between immediately adjacent stitches in excess of 3/32 inch (2.38 mm). By providing yarns of multiple colors and textures, a variety of patterns and textured surface effects are provided in the surface of the tufted pile fabric.

8 Claims, 3 Drawing Sheets

Fig. 4
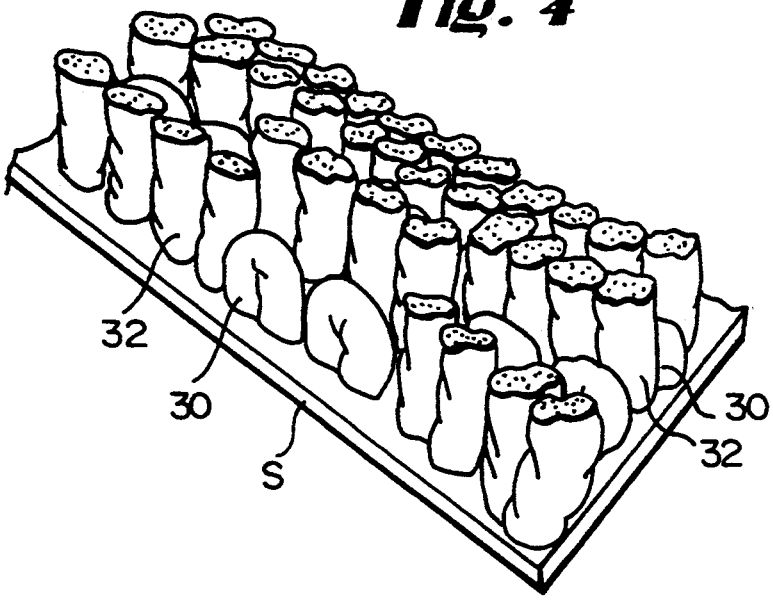
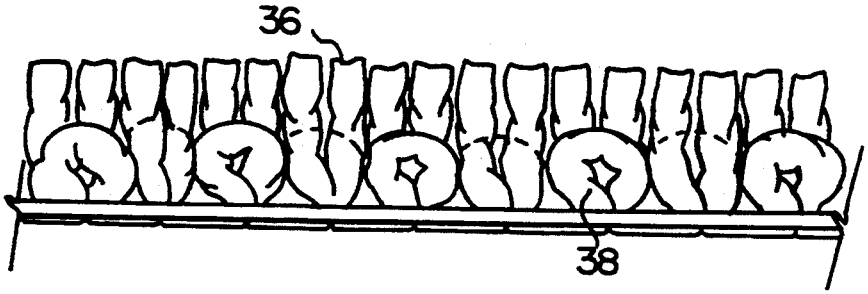
Fig. 5

TEXTURED SURFACE EFFECT FABRIC AND METHODS OF MANUFACTURE

TECHNICAL FIELD

The present invention relates to tufted pile fabrics and methods of manufacturing such fabrics and particularly relates to a tufted pile fabric affording novel and improved patterns and textures for surface effects and methods of manufacture.

BACKGROUND

As well known, tufted fabrics are those fabrics in which a plurality of pile yarns are pushed or stitched through a primary backing or substrate forming loops which comprise the fabric surface or which loops may be cut to form a cut pile fabric surface. Machinery for forming these tufted fabrics is likewise well known. In machinery of this type, one or more needle bars having a plurality of needles threaded with individual yarns are reciprocated, typically vertically, to pass the needles through the substrate to form loops which can remain as the fabric surface or be subsequently cut to form cut pile. The yarns are fed to the needle bars from yarn supply creels by one or more feed rolls. Where straight stitches are formed in the warp direction and the needle bar or bars are not shifted in the weft direction, the yarn feed rolls are typically controlled to provide a constant yarn feed to the needles. With a weftwise shift in the one or more of the needle bars, the yarn feed rolls are controlled to provide more or less yarn to the needles so that a smooth face of constant pile height relative to the substrate is maintained on the fabric surface.

In certain tufting machines, the feed rolls which control the yarn feed to the needles of the needle bar or bars are driven by servomotors which allow different lengths of yarn to be fed to the needles upon shifting the needle bar or bars. That is, when a needle bar shifts so that the needles are aligned with different hooks or loopers, there is insufficient yarn fed to the needles to preclude a chop or low line from appearing across the face of the fabric. To preclude this and to provide a smooth face across the fabric surface, a variation in yarn feed is adjusted by adjusting the servomotors driving the feed rolls to compensate for the extra yarn required to accommodate the weftwise movement of the needle bar. Thus, to avoid robbing previous tufts or stitches of yarn due to insufficient yarn feed to the next tuft or stitch, the servomotor controlled feed rolls in the past have been designed, programmed and utilized to provide the yarn feed compensation necessary to create a smooth face in the resulting fabric. That is to say, feed rolls for controlling yarn feed to the tufting needles have heretofore been driven by servomotors to allow different or preselected lengths of yarn to be fed to the needles when the needle bar or bars are shifted to new hook or looper positions, to enable the resulting fabric surface to remain smooth and level.

Further, tufted fabrics, i.e., fabrics having tufts of different heights throughout the fabric, have been provided in the past, for example, in carpets. Various techniques have been previously employed to provide tufted piles of such different heights. For example, cam disks have been used for varying the height of individual tufts in a stitch row in the weft direction. As the cam disks rotate, the yarn feed tension changes and differences in pile height are thus created. Roll pattern attachments, pattern slats and control scrolls have similarly been used to vary pattern height. However, in none of these prior tufting arrangements, has precise and accurate control of the height of each tuft been achieved in such manner that the difference in height between next-adjacent tufts in one or more stitch rows in the warp direction can be greater than 3/32 inch (2.38 mm). That is to say, with prior mechanisms, the variation in tuft height from one tuft to a succeeding tuft in the same stitch row in the warp direction has not exceeded 3/32 inch (2.38 mm). Where a jump in height of next-adjacent tufts in a warpwise stitch row in excess of 3/32 inch (2.38 mm) was required, the resulting fabric necessarily, because of the type of tufting apparatus used, had tufts of an intermediate height intervening between the tufts of the desired heights. That is, the incremental height adjustment of warpwise immediately next-adjacent tufts was limited in prior machines to 3/32 inch (2.38 mm) or less in the fabric, hence limiting the nature of the pattern in the fabric. These intermediate tufts produced an undesirable tapering effect in the tufts, albeit the fabric was patterned with warpwise non-next-adjacent tufts ultimately having a height differential in excess of 3/32 inch (2.38 mm).

DISCLOSURE OF THE INVENTION

In accordance with the present invention, unique patterns and textures providing novel and improved visual effects are achieved by utilizing a yarn feed control in a tufting apparatus to intentionally accurately and precisely create high and low areas in the tufted pile surface. The surface effects are enhanced and accentuated when yarns having different colors and/or textures are creeled and fed the various needles of the needle bar or bars.

In a preferred embodiment of the present invention, a tufting apparatus is provided having a pair of staggered needle bars. The needles of the front needle bar are fed by front yarn feed rolls, while the needles of the back needle bar are fed by back yarn feed rolls. Each of the front and back feed rolls are controlled independently by an associated servomotor. The servomotors of the front and back feed rolls are preferably programmed differently to provide different yarn feeds to the needles of the associated needle bar, with or without likewise shift of the needle bars, to provide high and low tufts in warpwise and/or weftwise adjacent stitches. For example, without shifting the needle bars, a high or low tuft striping effect may be created in the warp direction, with one or more rows of low tuft piles exposed to a greater or lesser extent between one or more rows of high tuft piles. By timing the occurrences of the formation of the high and low tufts on the front and back bars, high and low ribs across the fabric face can be formed. By timing the occurrences of the high pile stitches on the front bar out-of-phase with the high pile stitches on the back feed roll, an unusual texture is provided.

When one or both of the needle bars are shifted or stepped in the weft direction, a pattern of high and low or intermediate height tufts can be provided in both the warp and weft directions. Unique color combinations and variations in surface aesthetics can be achieved by a thread up of different colored yarns and/or yarns of different textures. By using servomotors to intentionally, precisely and accurately control yarn feed to provide high and low pile heights within a graphic tufted pattern, a completely different visual effect is achieved as compared with employing servomotors to compensate by yarn feed control for the more or less yarn required upon a needle bar shift to achieve a level surface in the resulting fabric.

In a preferred embodiment according to the present invention, there is provided a tufted pile fabric comprising a substrate, and a plurality of yarns stitched into the substrate in warpwise stitch rows and spaced weftwise from one another forming a tufted pile on one face of the substrate, at least one pair of immediately-adjacent tufts having a difference in height in one stitch row greater than 3/32 inch (2.38 mm).

In a further preferred embodiment according to the present invention, there is provided a method of manufacturing a tufted pile fabric comprising the steps of stitching a plurality of yarns into a substrate to form a tufted pile fabric and controlling yarn feed during stitching to provide a pattern effect in the tufted pile fabric with immediately-adjacent tufts in warpwise rows thereof having differences in heights of the tufts relative to the substrate and to one another, including (i) providing a servomotor for driving a yarn feed roll and (ii) incrementally advancing the yarn feed roll under control of the servomotor to provide the pattern effect in the tufted pile fabric including the differential heights of the tufts.

In a still further preferred embodiment according to the present invention, there is provided a method of manufacturing a tufted pile fabric comprising the steps of stitching a plurality of yarns from a yarn feed roll into a substrate to form a tufted pile fabric and effecting a pattern in the tufted fabric of different tuft heights in one-tuft increments in the warp direction by (i) providing a servomotor for driving the yarn feed roll and (ii) incrementally advancing the yarn feed roll under control of the servomotor to provide the pattern in one-tuft increments.

Accordingly, it is a primary object of the present invention to provide a novel and improved tufted fabric and methods of making the tufted fabric using servomotor controlled yarn feed rollers to create texture and patterns in the fabric.

BRIEF DESCRIPTION OF THE DRAWINGS

FIG. 4 is a fragmentary perspective view similarly as in FIG. 2 illustrating a combined cut/loop pile fabric; and FIG. 5 is a fragmentary side elevational view illustrating a fabric having alternating high cut pile and low loop pile in one stitch.

BEST MODE FOR CARRYING OUT THE INVENTION

Reference will now be made in detail to a present preferred embodiment of the invention, an example of which is illustrated in the accompanying drawings.

Figure 1:
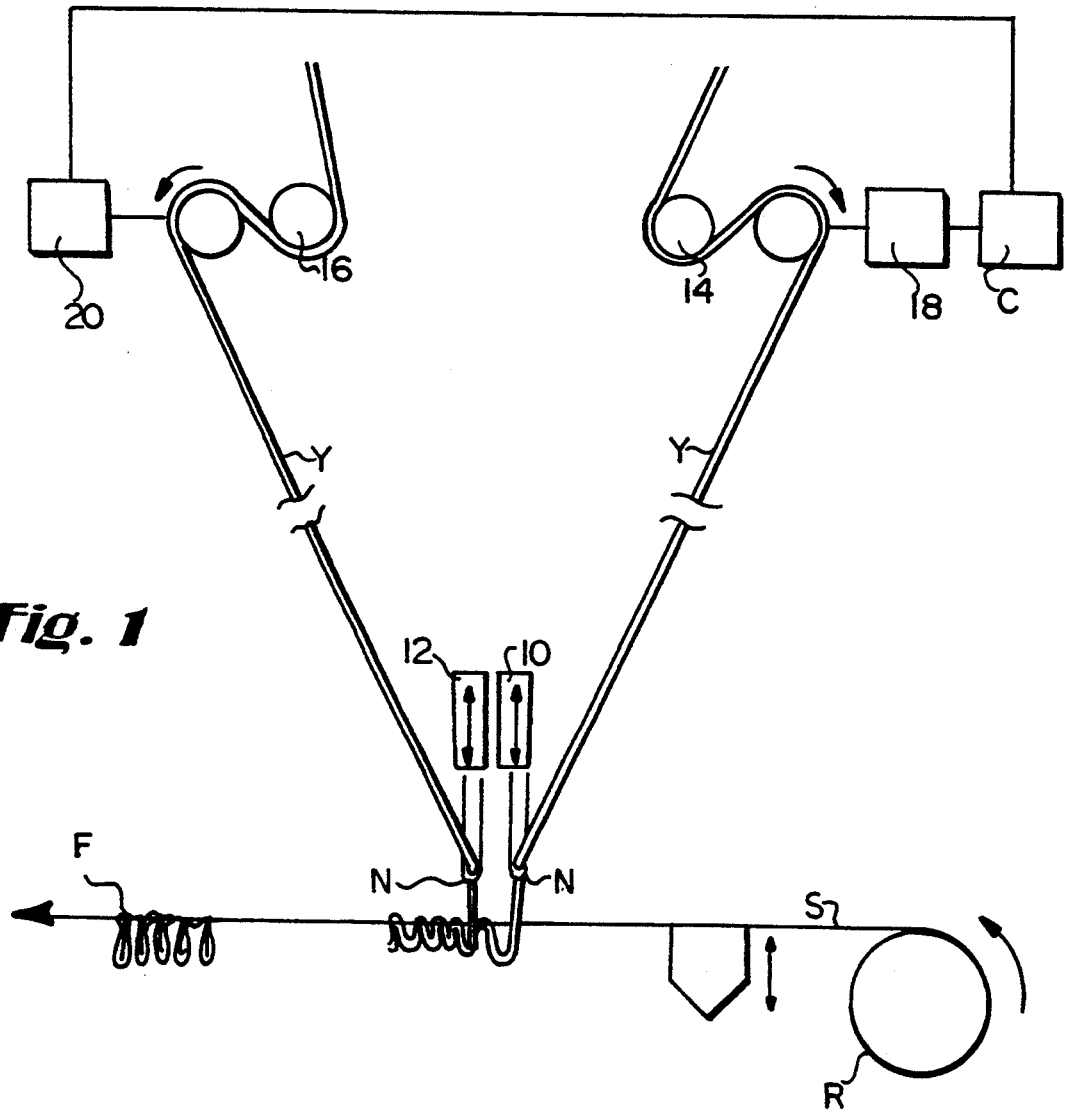
FIG. 1 is a schematic representation of a tufting apparatus for forming the tufted fabric according to the present invention.
Figure 3:
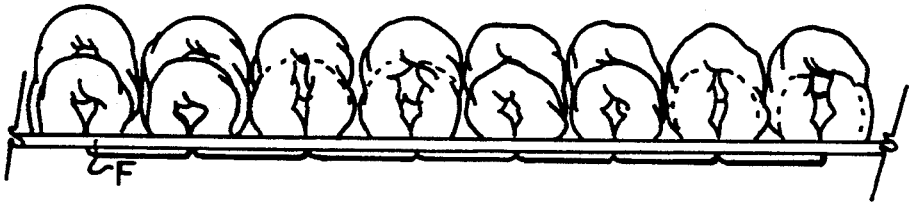
FIG. 3 is a cross-sectional view thereof taken generally about on line 3—3 in FIG. 2.

Referring now to FIG. 1, there is illustrated a tufting apparatus for forming a tufted fabric F. To form fabric F, a substrate S is provided on a roll R and is moved linearly in a longitudinal direction, indicated by the arrow. In the illustrated form, two needle bars are provided for forming the tufts in substrate S as the substrate moves longitudinally past the needle bars. Thus, front and back needle bars 10 and 12, respectively, are provided, although it will be appreciated that a single needle bar may be used in the present invention. As well known, each needle bar 10 and 12 includes a plurality of needles N spaced one from the other in the weft direction, with the needles of one bar being staggered weftwise relative to the needles of the other bar. The needle bars 10 and 12 are mounted for reciprocating movement toward and away from substrates, i.e., in the vertical direction indicated by the double arrows. Yarn Y is fed from a pair of feed rolls 14 and 16 from supply creels, not shown, to the eyes of the needles of the respective needle bars 10 and 12. It will be appreciated that a plurality of yarns are fed to each of the front and back feed rolls 14 and 16, as is conventional. Servomotors 18 and 20 are drivingly coupled to the feed rolls 14 and 16, respectively, for incrementally advancing the feed rolls and hence the yarns for supplying the yarns to the needles of the front and back needle bars, respectively. The operation of the servomotors 18 and 20 is under the control of a computer C, which, in accordance with the present invention, instructs the servomotors to drive the feed rolls to supply the same or a greater or lesser extent of yarns in each of the front and back needle bars in accordance with a predetermined program.

In an exemplary embodiment of a tufting apparatus for use in producing a tufted fabric, e.g., a carpet, according to the present invention, the front and back needle bars 10 and 12, respectively, may be spaced one from the other in the warp direction of the tufting machine a distance, for example, of 0.25 inches. The needles on each needle bar may be spaced one from the other in the weft direction on 1/5 inch (5.08 mm) centers and, hence, the needles of the front and back needle bars provide a 1/10 gauge. For manufacturing a typical twelve-foot wide carpet, for example, there would be a total of 1,440 needles in a 1/10 GA tufting machine with each needle bar carrying 720 needles and hence 720 discrete yarns.

While not shown in the drawings, each needle bar is associated with a plurality of weftwise spaced loopers for forming tufted loop pile or with hooks-and-knives for forming tufted cut pile. The loopers or hooks-and-knives are, of course, located below the substrate S as viewed in FIG. 1, a separate set of loopers or hooks-and-knives being provided each needle bar.

In accordance with the present invention, servomotors 18 and 20 are provided to independently adjust the yarn feed precisely and accurately for each of the front and back feed rolls 14 and 16, respectively, in a predetermined number of increments. For example, eight different increments of movement may be provided within a predetermined total range of movement. In this example, therefore, eight different yarn feeds may be provided each of the front and back feed rolls independently of one another. Thus, various combinations of yarn feeds among the front and back feed rolls are provided. Also, a selected yarn feed corresponding to a selected increment of the servomotor is programmed for each weftwise row of stitches in the fabric to provide a preselected height of tuft in that tow. Accordingly, by variously incrementally adjusting the servomotors under computer control, the magnitude of the yarn feed for each needle bar for each weftwise row of stitches is predetermined. The height of each tuft above the substrate in each weftwise extending stitch row can therefore be selectively accurately and precisely adjusted by preselecting the incremental advance of the associated servomotor. Thus, the height of immediately-adjacent stitches in each warpwise extending row can be varied precisely and accurately according to each selected increment of servomotor advance. Further, by placing yarns of various colors or textures, or both, in a planned thread-up for each needle bar, a wide variety of patterning can be provided.

By employing servomotor driven yarn feed rolls, the present invention achieves patterning effects in the fabric surface not heretofore obtainable. This is due to the ability of the servomotor to accurately and precisely control the yarn feed for each warpwise stitch such that the height of next-adjacent tufts in the warp direction can be accurately and precisely controlled. That is, the servomotors provide the instantaneous response necessary for the accurate and precise underfeed or overfeed of the yarn to form the desired pile height in the pattern. Particularly, this permits jumps in heights between next-adjacent warpwise tufts in excess of 3/32 inch (2.38 mm) and which height jumps were not obtainable without tufts of in-between height intervening between immediately-adjacent warpwise tufts in fabrics produced by prior tufting machinery. Also, because of the use of two needle bars, timed in operation relative to one another, the present invention also provides for accurate and precise differences in height between next-adjacent stitches in the weft direction including height differentials in excess of 3/32 inch (2.38 mm).

Figure 2:
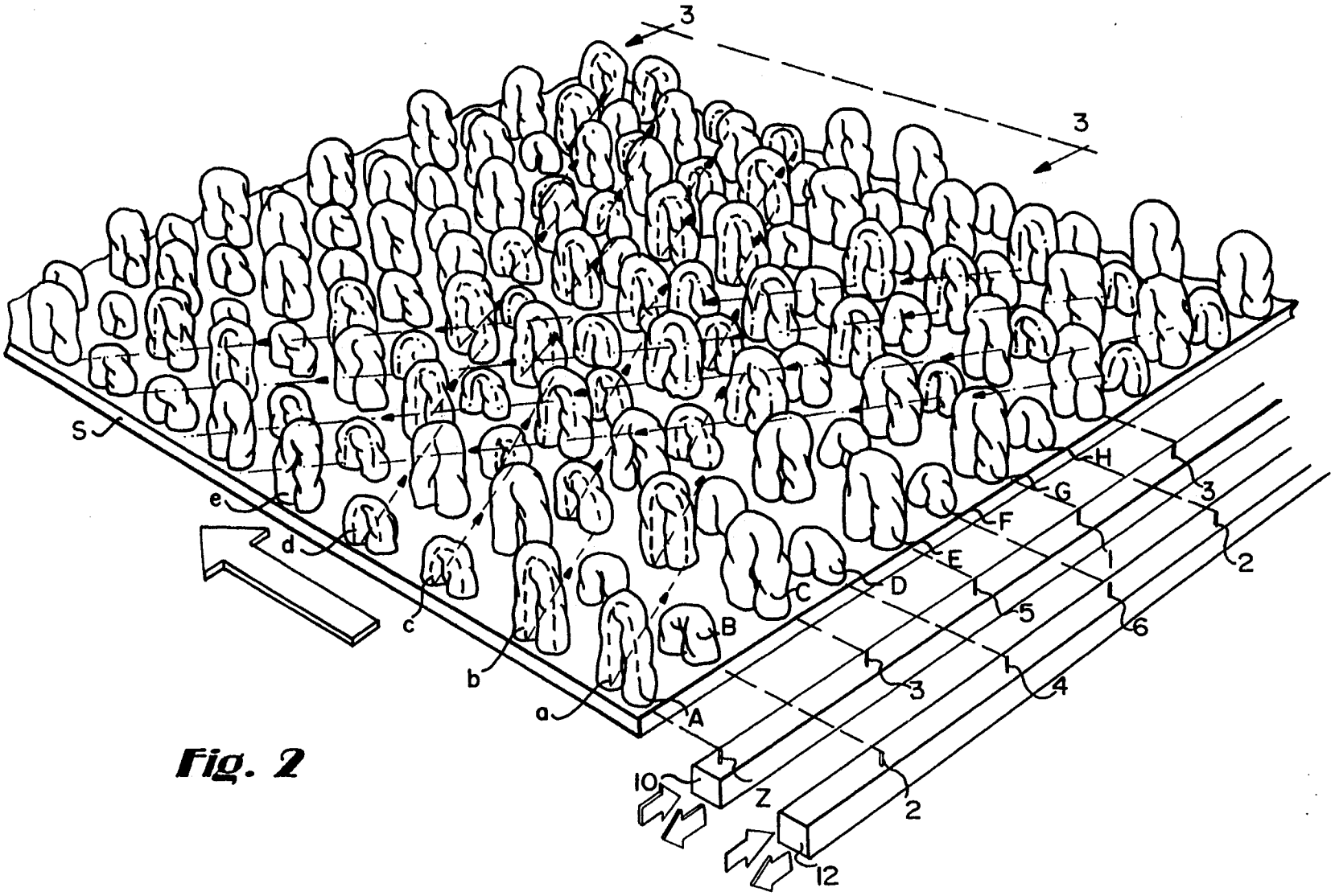
FIG. 2 is a fragmentary perspective view illustrating the tufted surface of a fabric constructed in accordance with the present invention.

Referring now to a specific embodiment of the present invention illustrated in FIG. 2, there is provided a tufted loop pile fabric comprising the substrate S and a plurality of rows of stitches forming tufts extending in the machine or warp direction, as indicated by the arrow. The needle bars 10 and 12 and individual needles on those bars are also schematically illustrated. It will be appreciated that FIG. 2 illustrates the fabric from the tufted side of the fabric, the needle bars 10 and 12 forming the tufts from the underside of the substrate S in this view. In contrast, the illustration in FIG. 1 shows the manufacture of the fabric, with the backside of the substrate facing upwardly and the tufts facing downwardly from the substrate. The step of the needle bars 10 and 12 in the weft direction is illustrated by the weftwise distance between the dashed lines from the needles to the stitches formed by those needles.

In this form of exemplary fabric, it will be appreciated from a review of drawing FIG. 2, that a plurality of rows of stitches are formed, with the stitches in each row in the warp direction having two high piles followed by two low piles with that configuration being repeated in the machine direction. Additionally, the two high piles in each warpwise stitch row lie in registration with two low piles in the adjoining stitch row. Depending upon the relative difference in height between high and low tufts, the low tufts will, for large height differentials, be obscured or blocked from view by the high tufts. For example, where the difference in height between the high and low tufts, whether in the warp or weft directions, or both, is about 5/32 inch (3.97 mm) or more, the low piles will be substantially obscured from view in a 1/10 gauge fabric with a ¼ inch stagger between needle bars. Obviously, the nature of the pile yarn will also, to some extent, determine whether or not the low loop tufts are obscured and the difference in height between the high and low tufts necessary for those low tufts to be obscured.

It will be appreciated that a variety of patterning effects may be accomplished by varying the high and low tufts within the fabric. For example, a striping or ribbing effect in the warp direction can be accomplished by maintaining the tufts in one or more weftwise adjacent rows in a low pile configuration, while an intervening row or rows of tufts in the warp direction have a high pile configuration. High and low checkerboard patterns can be obtained, for example. Also, meandering high and low patterns can be provided throughout the fabric. It will be appreciated that these various combinations of high and low tufts can be provided because of the precise and accurate incremental yarn feed control, and hence yarn height control for each tuft, afforded by the servomotors. This precision and accuracy of control in the formation of patterns in the fabric has heretofore been unknown and particularly controlling heights in the warp direction of immediately-adjacent tufts in excess of 3/32 inch (2.38 mm) height differentials.

Additional aesthetic characteristics can be accomplished by color variations in and/or textures of the plurality of yarns provided the fabric. For example, and for color variation, if the yarns supplied the front needle bar 10 have a three-color repeat for needles 1, 3 and 5 across the machine width, then similarly the yarns supplied the back needle bar 12 have a three-color repeat for needles 2, 4 and 6 (the colors in each needle bar being different). Variations in color readily appear in the fabric depending on weftwise movement of the needle bars and pile height. For example, for most yarns and fabrics, the low loop will be obscured, and hence their colors, by the adjacent high loops if the height differential exceeds a predetermined value, e.g., 5/32 inch (3.97 mm).

FIG. 2 illustrates a single-step sequence for each needle bar for each stitch. That is, the front and back bars move one step in opposite weftwise directions for each stitch for a predetermined number of steps before returning in similar but opposite steps to the neutral position. Thus, for the first transverse stitch row a, yarns 1, 3, 5 of different colors appear in warpwise stitch rows A, C and E as high loops. In that same transverse stitch row, different color yarns 2, 4 and 6 appear as low loops in warpwise stitch rows B, D and F. In the next warpwise stitch row, the needle bars 10 and 12 have been shifted one step in opposite weft directions as indicated by the arrows. Accordingly, yarn 1 appears in weft stitch row b, warp row C as a high loop. Yarn 3 appears in weft row b, warp row E as a high loop. Stitch yarn 5 appears in weft row b, warp row G as a high loop. With the shift of the back needle bar 12, yarn 2 is shifted from warp row H, weft row a, to warp row F, weft row b and appears as a low loop. Yarn 6 shifts from warp row F, weft row a, to warp row D, weft row b and appears as a low loop. Yarn 4 shifts from warp row D, weft row a to warp row E, weft row b and appears as a low loop.

Upon the second shift of needle bar 10 to the right, stitch yarn 1 becomes a low loop in warp row E, weft row c and, in the next stitch and after the next step, becomes a low loop in warp row G, weft row d as a low loop. Stitch yarns 3 and 5 are similarly shifted in location and height. Stitch yarn 2, upon the second shift of needle bar 12 to the left, becomes a high loop in warp row D, weft row c and, in the next stitch, becomes a high loop in warp row B, weft row d. Stitch yarns 4 and 6 are similarly shifted in location and height.

The pattern repeats itself throughout the fabric, with a predetermined number of steps of the needle bars and stepped return before the sequence is repeated. The servomotors are incrementally advanced to provide additional yarn to accommodate the further yarn needed to step from one warp row to a different warp row for each stitch in the illustrated form and also any more or less yarn to provide precise and accurate height control.

Consequently, with a height differential between the high and low loops sufficient to obscure the low loops from view, e.g., 5/32 inch (3.97 mm), the colors of yarns 1, 3 and 5 appears in the fabric when the tufts formed by yarns 1, 3 and 5 form high loops and are obscured in the fabric when the tufts formed by yarns 1, 3 and 5 form low loops. Similarly, the colors of yarns 2, 4 and 6 appear in the fabric when the tufts formed by yarns 2, 4 and 6 form high loops and are obscured in the fabric when yarns 2, 4 and 6 form low loops. With the virtually unlimited patterns of high and low tufts and variations in color available, coupled with the capacity to precisely and accurately control the height of the tufts from stitch to stitch including height differentials in excess of 3/32 inch (2.38 mm), a wide variety of different patterns and textures is available.

It will be appreciated that the foregoing description with respect to FIG. 2 applies equally to cut/loop piles and is not limited to the illustrative example of looped pile fabric. Additionally, the present invention is applicable to combined cut/loop pile fabrics, e.g., illustrated in FIG. 4. Thus, a pattern of low loops and high cut loops 30 and 32, respectively, may be provided as illustrated similar to the previously described pattern but with the high loops cut.

With reference to FIG. 5, there is illustrated a fabric having alternating high cut tufts and low loop tufts for each stitch. The high cut tufts 36 and the low loop pile 38 provide a difference in tuft height in successive stitches in excess of 3/32 inch (2.38 mm) between immediately adjacent stitches in the warp direction. In the illustrated form, the rows of stitches alternate vis-a-vis the location of the high cut tufts and the low loop tufts in the weft direction.

In a preferred embodiment and as a representative example hereof, the tufting machine may be driven at 500 rpm to provide about 8.33 stitches per second. Accordingly, the present invention can provide a difference in tuft height in excess of 3/32 inch (2.38 mm) between immediately-adjacent stitches in the warp direction in about 0.24 seconds and this can be accomplished with a needle bar shift of up to three gauges. At a maximum speed of about 1100 rpm, about 18 stitches per second can be provided affording a difference in tuft height in excess of 3/32 inch (2.38 mm) between immediately-adjacent stitches in the warp direction in about 0.11 seconds.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A method of manufacturing a tufted pile fabric comprising the steps of:

providing front and back needle bars spaced one from another in a warp direction with each bar carrying a plurality of needles spaced from one another in the weft direction with at least one needle bar movable in a weft direction relative to another of said needle bars;

supplying a plurality of yarns to a single feed roll for each of the front and back needle bars, respectively;

stitching a plurality of yarns into a substrate by operation of the needle bars to form a tufted pile fabric;

controlling yarn feed to said needle bars during stitching to provide a warpwise pattern effect in the tufted pile fabric with immediately adjacent tufts in warpwise rows thereof having different heights relative to the substrate and to one another, including (i) providing a single servomotor for driving each yarn feed roll and (ii) incrementally advancing each said yarn feed roll under control of said servomotor to provide the warpwise pattern effect in the tufted pile fabric; and controlling the movement of said one needle bar in the weft direction to effect a difference in height between next-adjacent stitches in the weft direction, thereby providing warpwise and weftwise patterning effects.

2. A method according to claim 1 wherein the step of controlling yarn feed includes incrementally advancing said yarn feed roll under control of said servomotor to provide a height difference in immediately-adjacent stitches in excess of 3/32 inch.

3. A method according to claim 2 wherein the step of controlling yarn feed includes incrementally advancing said yarn feed roll under control of said servomotor to provide a height difference in immediately-adjacent stitches of about 5/32 inch.

4. A method of manufacturing a tufted pile fabric comprising the steps of:

providing front and back needle bars spaced one from another in a warp direction with each bar carrying a plurality of needles spaced from one another in the weft direction with at least one needle bar movable in a weft direction relative to another of said needle bars;

supplying a plurality of yarns to a single feed roll for each of the front and back needle bars, respectively;

stitching a plurality of yarns from said yarn feed rolls into a substrate to form a tufted file fabric; and effecting a pattern in the tufted fabric of different tuft heights in one-tuft increments in the warp and weft directions by (i) providing a single servomotor for driving each yarn feed roll; (ii) incrementally advancing said yarn feed roll under control of said servomotor; and (iii) controlling the movement of said one needle bar in the weft direction while incrementally advancing the yarn feed rolls by said servomotors.

5. A method according to claim 4 including incrementally advancing said yarn feed roll under control of said servomotor to provide a difference in tuft height in immediately-adjacent warpwise stitches in excess of 3/32 inch.

6. A method according to claim 4 including incrementally advancing said yarn feed roll under control of said servomotor to provide a height difference in immediately-adjacent warpwise stitches of about 5/32 inch.

7. A method according to claim 4 including stitching at a rate of about 8 stitches per second or more and effecting said pattern by stitching at said rate or more to obtain a difference in tuft height between immediately-adjacent warpwise stitches in excess of 3/32 inch in about 0.24 seconds or less.

8. A method according to claim 5 including the steps of providing a loop pile and a cut pile in immediately-adjacent warpwise stitches.

* * * * *

UNITED STATES PATENT AND TRADEMARK OFFICE

CERTIFICATE OF CORRECTION

PATENT NO. : 5,383,415
DATED : January 24,1995
INVENTOR(S) : WILLIAM P. PADGETT, III

It is certified that error appears in the above-identified patent and that said letters patent is hereby corrected as shown below:

Column 6, line 57, change "warp row E" to --warp row B--.

Signed and Sealed this

Twenty-third Day of May, 1995

*Attest:*

Bruce Lehman

BRUCE LEHMAN

*Attesting Officer*

*Commissioner of Patents and Trademarks*